US006705742B1

(12) United States Patent
Patterson et al.

(10) Patent No.: US 6,705,742 B1
(45) Date of Patent: Mar. 16, 2004

(54) SYSTEM FOR DIRECTING LIGHT FROM A LUMINAIRE

(75) Inventors: David Patterson, Rio Rancho, NM (US); Ramiro Barajas, Rio Rancho, NM (US)

(73) Assignee: Insight Lighting, Inc., Rio Rancho, NM (US)

( * ) Notice: Subject to any disclaimer, the term of this patent is extended or adjusted under 35 U.S.C. 154(b) by 0 days.

(21) Appl. No.: 10/226,589

(22) Filed: Aug. 23, 2002

(51) Int. Cl.[7] ..... F21S 4/00

(52) U.S. Cl. ..... 362/224; 362/147; 362/346; 362/217; 362/221; 362/222; 362/223; 362/367

(58) Field of Search ..... 362/224, 147, 362/346, 217, 221, 222, 223, 367, 297, 298, 281, 269

(56) References Cited

U.S. PATENT DOCUMENTS 4,651,260 A * 3/1987 Lasker ..... 362/281

6,450,668 B1 * 9/2002 Kotloff ..... 362/269

* cited by examiner

*Primary Examiner*—Sandra O'Shea
*Assistant Examiner*—Mark Tsidulko
(74) *Attorney, Agent, or Firm*—Law Office of Ray R. Regan, P.A.

(57) ABSTRACT

A system for directing light from a luminaire. The system for directing light from a luminaire, according to the present invention, includes a source of light. A first reflecting device is installed in the luminaire for reflecting light from the source of light and directing substantially indirect lighting from the luminaire. The first reflecting device is formed with an opening. The opening allows unreflected light to pass through the first reflecting device to a second reflecting device mounted in the luminaire. The first reflecting device includes a window mountable in the opening for diffusing light. The first reflecting device also includes a lens. The second reflecting device is a multiple surface reflector assembly for directing a combination of direct lighting and luminous lighting from the luminaire through and along a fascia that is engageable with the luminaire.

24 Claims, 7 Drawing Sheets

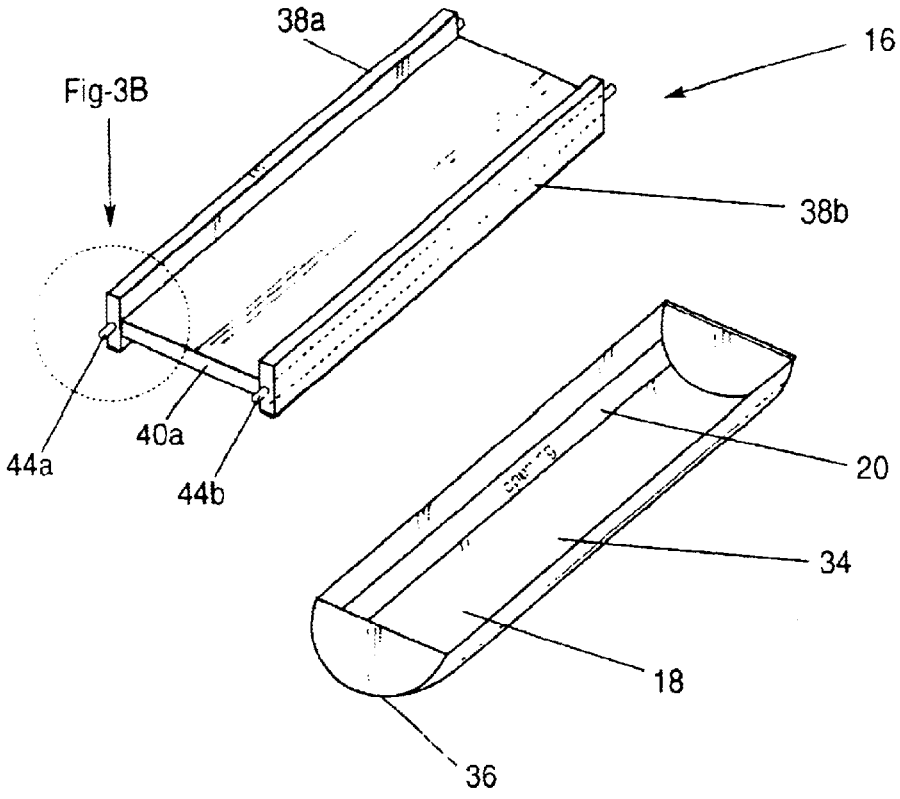
FIG-3A
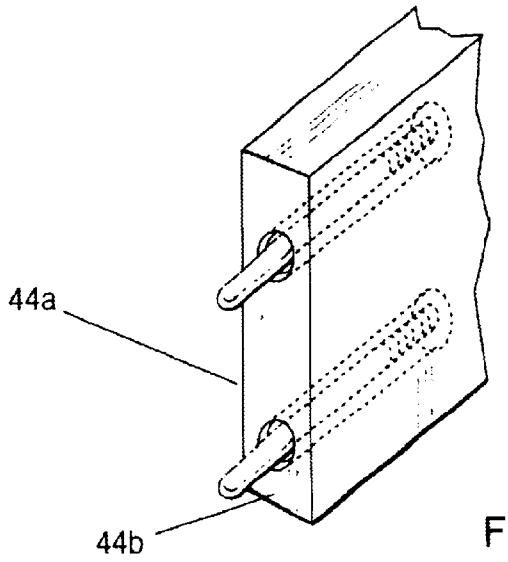
FIG-3B
FIG-3

SYSTEM FOR DIRECTING LIGHT FROM A LUMINAIRE

FIELD OF THE INVENTION

The present invention pertains generally to lighting apparatus. More particularly, the new and useful invention claimed in this document pertains to a system for directing light from a luminaire in a variety of directions to achieve high performance and a number of aesthetic effects. The present invention is particularly, but not exclusively, useful for providing combinations and permutations of direct and indirect lighting.

BACKGROUND OF THE INVENTION

Lighting apparatus and fixtures, commonly referred to in the lighting industry as "luminaires," are ubiquitous sources of light in modern industrialized nations both in residential, commercial, and other environments. Luminaires are expected to provide not only effective and energy-efficient radiant energy in the form of light, but also ambiance and aesthetics. Indeed, interior and exterior lighting presents at least two persistent challenges, performance and aesthetics.

The term "performance" means and is concerned with qualitative and quantitative aspects of light and lighting, as well as the flexible capability to direct light where lighting is desired. The term "aesthetics" includes not only the ambiance provided by a source of light that makes vision possible, but also the sensation aroused by stimulation of visual receptors. Thus, while it may be interesting from an engineering perspective that light is an electromagnetic radiation in wave length ranges that include infrared, visible, ultraviolet light, as well as x-rays, when traveling in a presumed vacuum at a speed of about 186,281 miles per second, and can be seen or sensed by the human eye, a luminaire is expected to present a pleasant appearance, permit adjustable direction of light that contributes to creating a pleasant mood and ambiance, while also providing useful energy-efficient light where desired. Therefore, a lighting fixture, or luminaire, must provide clean lines, appealing proportions in virtually any environment, problem-free installation and alignment, and years of reliable service. A luminaire also must be efficient, and use the least amount of electricity while achieving the highest performance and the best aesthetics.

Efforts to achieve both high performance and superb aesthetics have induced the industry to manufacture luminaire housings from a wide variety of materials. Smooth and textured coatings for luminaires have been provided. Minimal visible hardware components seek to achieve refined architectural design. In addition, luminaires have been designed to provide uniform output of light, free from streaks and striations. A variety of lamps have been developed in response to the demand for different quantities, qualities and colors of light. Accordingly, modern luminaires may use a variety of lamps, including quartz halogen, compact fluorescent, ceramic metal halide, and metal halide lamps. Microprismatic lenses, white or colored defusing lenses, ultraviolet and colored filters, baffled glare shields, cut off visors and similar apparatus have also been introduced into modern luminaires, also in the continuing effort to achieve both performance and aesthetics. Two patents demonstrating exemplary industry efforts to achieve performance and aesthetics include U.S. Pat. No. Des. 396,321, issued Jul. 21, 1998, and U.S. Pat. No. Des. 396,320, issued Jul. 21, 1998, both issued to one of the co-inventors of the present invention, and assigned to Insight Lighting, Inc.

Considerable efforts also have been devoted to evolving mathematical formulae and calculations to predict lighting performance and aesthetics. One series of formulae, for example, has been developed for determining illumination provided by a particular luminaire when positioned or mounted at a point $P^1$. Cubic illumination at $P^1$ is a function of six illuminances on the faces of a presumed cube, consisting of three opposed pair of illuminances on x, y and z-axes. From such data, an illumination vector $E^1$ (X,Y,Z) may be determined. It is known that 3-dimensional illuminance distribution at any point in space is the sum of two components, the vector component $E^1$ and the symmetric component. The vector component and symmetric component together generate illumination patterns that are variations of light and shade formed on the surface of solid objects that intercept a flow of light. For each object, the illumination pattern is the sum of the effects of these two components. Light, therefore, to those who invent, design and manufacture light and lighting fixtures, or luminaires, is thought of at least in part in terms of light and shade patterns, and the sum of effects generated by the vector and symmetric components. It is the combination of light and shade patterns that are vital to visualize illumination.

Of course, quantification aspects of calculating light also is important. "Quantification" is concerned with the quantity of light produced by a given luminaire. Cubic illumination may be determined either by calculation or by measurement of the six cubic illuminances. Illuminance, however, may be applied to two distinctly different types of lighting problems, namely eye illumination, and object illumination. For example, eye illumination may be considered from the point of view of scalar illuminates, or the average illuminance of a small sphere, which is a simple metric that evaluates both light arriving at the eye from all directions, and which provides an indicator of ambient light level in an illuminated space rather than from the perspective of a horizontal plane illuminance.

Reflection, or the return of light waves from a surface, also has considerable impact on both performance and aesthetics of a luminaire. It is known that an incident beam of light may be reflected, or returned, from a smooth surface as a reflected beam, and that the angle the incident beam makes with an imaginary line called the "normal" that is at right angles to the reflection surface equals the angle made by the reflected beam, but on the other side of the normal.

To achieve performance and aesthetics from a luminaire, luminosity also is important. Luminosity is concerned with emitting or reflecting light, usually in the form of a steady, suffused, or glowing light. Reflectance, on the other hand, is concerned with the fraction of the total radiant flux of luminosity that is incident upon a surface that is reflected, and that varies according to the wave length distribution of incident radiation. To determine the quality or quantity of reflectance, the nature of the reflective surface must be known. Some reflective surfaces are specular, having the qualities of a mirror. Orientation of a reflective surface to the source of incident radiation in the form of light also affects reflectance. Diffuse or matte surfaces tend to veil reflections that in turn reduce the range of colors.

Luminance, however, like reflectance, is non-uniform. Furthermore, reflectances are usually demand-set by an architect or interior designer so that lighting or luminance determinations rest on the selection of illuminances. Thus it is clear that altering reflectances in a luminaire will affect performance and aesthetics, those two twin persistent challenges to the inventor and designer of luminaires. In part, these are issues addressed by the present invention.

Conventional luminaires tend to achieve performance without luminosity; or they provide luminosity, but lack performance. In other words, current suggestions for achieving performance and aesthetics from a luminaire solve one problem, but not both. In an indirect luminaire, one from which light is emitted substantially upward or vertically from the luminaire, performance may be achieved in present luminaires without providing fascia glow. Alternatively, in an indirect luminaire, conventional units may provide fascia glow, or luminosity, but unacceptable performance. As used in this document, the term "fascia" generally refers to a variously shaped member that is selected and designed to emit light through the member. Thus, fascia may include a member made from glass, Plexiglas, various plastics, resins. Fascia also may include any material in which a wide variety of voids have been formed to create aesthetic lighting results. Thus, fascia may include trademarks, company names, almost any decorative addition imaginable, that may be etched, painted, or otherwise placed on the fascia member.

Therefore, a previously unaddressed need exists in the industry for a new, useful and improved lighting fixture, or luminaire, and a method for manufacturing such an apparatus, that is capable of achieving performance, fascia luminosity, and aesthetics. Particularly, there is a significant need in the industry for a method and apparatus that provides a luminaire that may be mounted on a wall or ceiling, and that directs light to where a user wants it using novel and unique reflector performances, while also providing direct fascia that provide aesthetically desirable luminosity.

SUMMARY OF THE INVENTION

Given the conventional solutions for attempting to solve the problems associated with lighting fixtures, particularly lighting fixtures directed to achieving both performance and aesthetics, it would be desirable, and of considerable advantage, to provide a system for directing light from a luminaire that provides for transmitting substantially indirect lighting from the luminaire, transmitting substantially direct lighting from the luminaire, and emitting substantially luminous direct lighting, all from the same lighting fixture or luminaire.

The present invention provides numerous advantages in connection with such a system for directing light from a luminaire. At least one advantage of the present invention is that it achieves all three objectives of providing a luminaire that transmits substantially indirect lighting, transmits substantially direct lighting, and also includes a fascia for emitting substantially luminous direct lighting. The accomplishment of those three objectives simultaneously by the present invention is referred to in this document as the "Simultaneous Tripartite Advantages".

Another advantage of the present invention is that the Simultaneous Tripartite Advantages are performed by the luminaire simultaneously.

Still another advantage of the present invention is its capability to use a single source of light, or a lamp, that is removably positionable in the luminaire to provide the Simultaneous Tripartite Advantages.

Yet another advantage of the system for directing light from a luminaire is that a variety of different lamps may be installed in the luminaire to satisfy varying demands for the quality and quantity of light.

Another advantage of the present invention is the ability to etch or otherwise decorate fascia of the apparatus to cast a variety of aesthetically unusual light designs from the luminaire.

Yet another advantage of the present invention is a luminaire, and a method for manufacturing a luminaire, which respectively are easy to use and to practice, and which are cost effective for their intended purposes.

These and other advantages of the present invention are achieved by providing a housing in which a lamp is removably positionable for providing light. A frame connectable to the luminaire is included. A lens is mountable in the frame, and contributes to transmitting substantially indirect lighting from the luminaire. An optical surface is installed in the housing for reflecting light. The optical surface is substantially concave in configuration in the direction from which incident light is received on the optical surface. An opening is formed in the optical surface. The opening in the optical surface is provided for conveying unreflected light toward a multiple surface reflector assembly. The multiple surface reflector assembly is connected to the housing adjacent the opening for reflecting transmitted light. As used in this document, the term "transmitted light" or "unreflected light" includes light from the lamp that is not reflected front the optical surface, but instead passes through the opening in the optical surface to the multiple surface reflector assembly. A window may be mounted in the opening for focusing or filtering the transmitted light toward the multiple surface reflector assembly. In addition, a luminous direct fascia is provided. The luminous direct fascia may be slidably engageable or fixed in the housing, and is formed to emit direct light in the form of luminosity. In addition, means are provided that may be connected to the housing for energizing the lamp. Means mountable to the housing are provided for attaching the luminaire to an object, such as the surface of a wall.

It will become apparent to one skilled in the art that the claimed subject matter as a whole, including the structure of the apparatus, and the cooperation of the elements of the apparatus, combine to result in a number of unexpected advantages and utilities. The advantages and objects of the present invention, and features of such a system for directing light from a luminaire, will become apparent to those skilled in the art when read in conjunction with the accompanying following description, drawing figures, and appended claims.

The foregoing has outlined broadly the more important features of the invention to better understand the detailed description which follows, and to better understand the contribution of the present invention to the art. Before explaining at least one embodiment of the invention in detail, it is to be understood that the invention is not limited in application to the details of construction, and to the arrangements of the components, provided in the following description or drawing figures. The invention is capable of other embodiments, and of being practiced and carried out in various ways. Also, the phraseology and terminology employed in this disclosure are for purpose of description, and should not be regarded as limiting.

As those skilled in the art will appreciate, the conception on which this disclosure is based readily may be used as a basis for designing other structures, methods, and systems for carrying out the purposes of the present invention. The claims, therefore, include such equivalent constructions to the extent the equivalent constructions do not depart from the spirit and scope of the present invention. Further, the abstract associated with this disclosure is neither intended to define the invention, which is measured by the claims, nor intended to be limiting as to the scope of the invention in any way.

The novel features of this invention, and the invention itself, both as to structure and operation, are best understood from the accompanying drawing, considered in connection with the accompanying description of the drawing, in which similar reference characters refer to similar parts, and in which:

BRIEF DESCRIPTION OF THE DRAWING

FIG. 3A is an exploded perspective view of the first reflecting device and frame;

FIG. 3B is a partial cut-away perspective view of a portion of the frame showing spring-loaded rods.

DESCRIPTION OF A PREFERRED EMBODIMENT

Briefly, the present invention provides a system for directing light from a luminaire. In a preferred embodiment of the present invention the system for directing light from a luminaire includes, in general, a source of light removably positionable in the luminaire, a first reflecting device installed in the luminaire for transmitting substantially indirect lighting from the luminaire, a second reflecting device mounted in the luminaire for transmitting substantially direct lighting from the luminaire, and a fascia engageable with the luminaire for emitting substantially luminous direct lighting. Means also are provided for energizing the source of light, and for attaching the luminaire to an object such as a wall.

Figure 1:
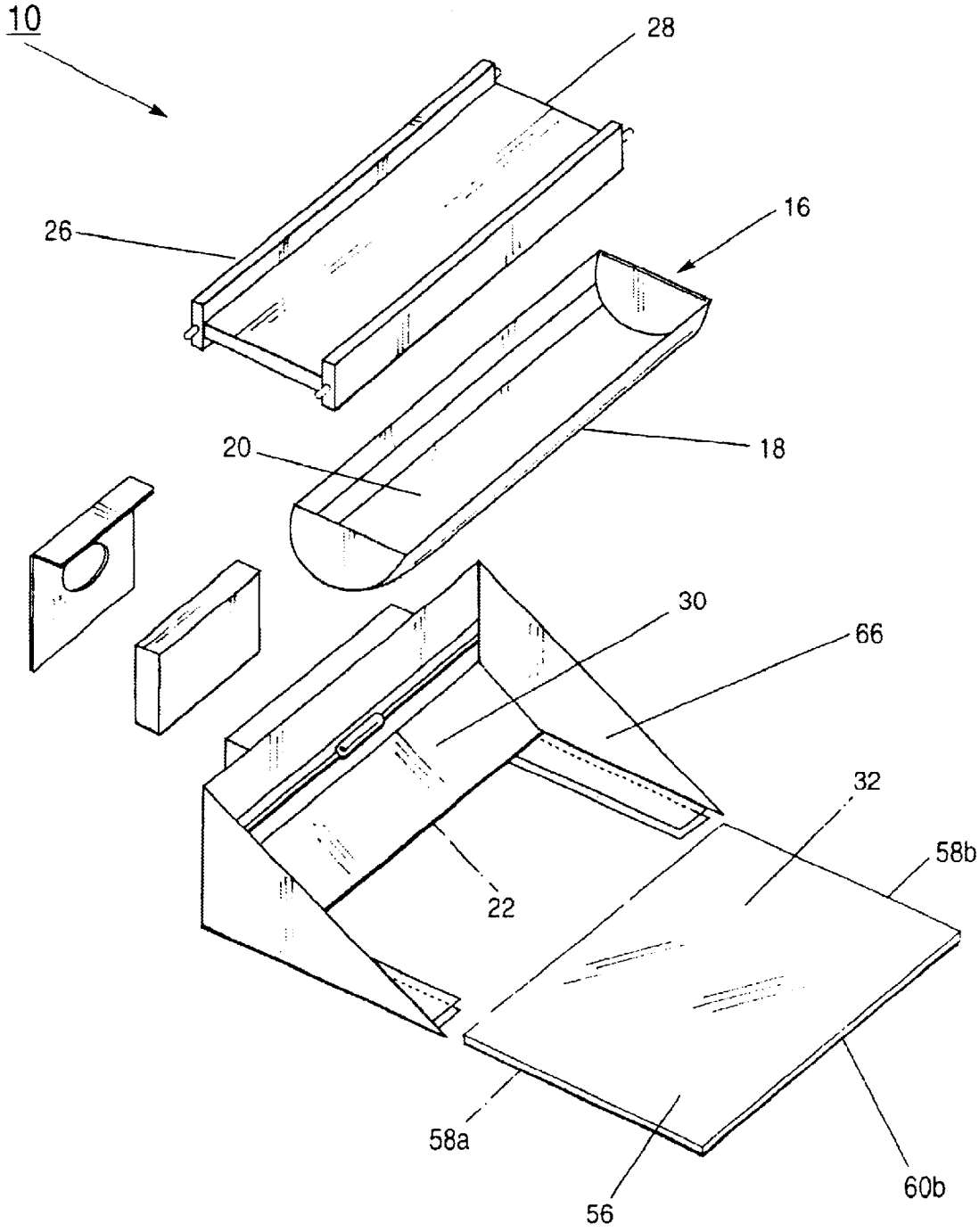
FIG. 1 is an exploded perspective view of the system for directing light from a luminaire.

More specifically, FIG. 1 is an exploded perspective view of the system for directing light from a luminaire. Referring initially to FIG. 1, therefore, the system for directing light from a luminaire is shown and generally designated 10. As shown perhaps best by reference to FIG. 5, system for directing light from a luminaire 10 includes in its broadest aspect a source of light 12. Source of light 12 in a preferred embodiment of the present invention is a lamp 12' removably positionable in luminaire 14.

Figure 5:
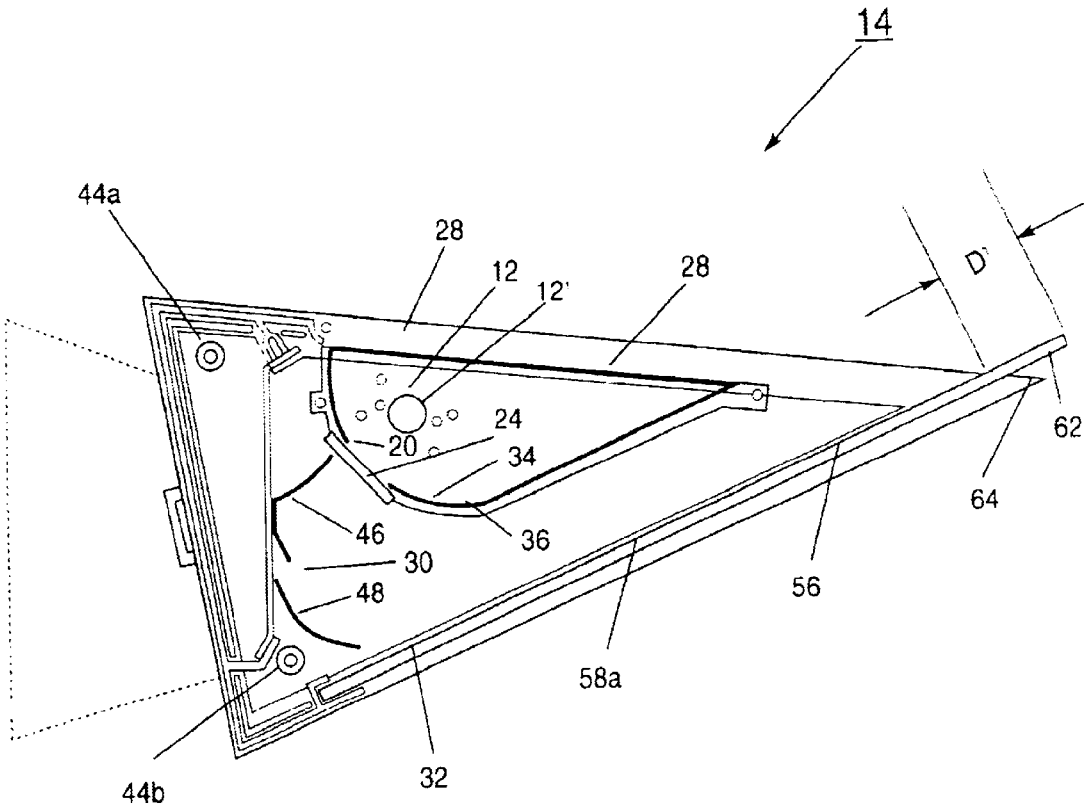
FIG. 5 is a side view of the system for directing light from a luminaire.
Figure 6:
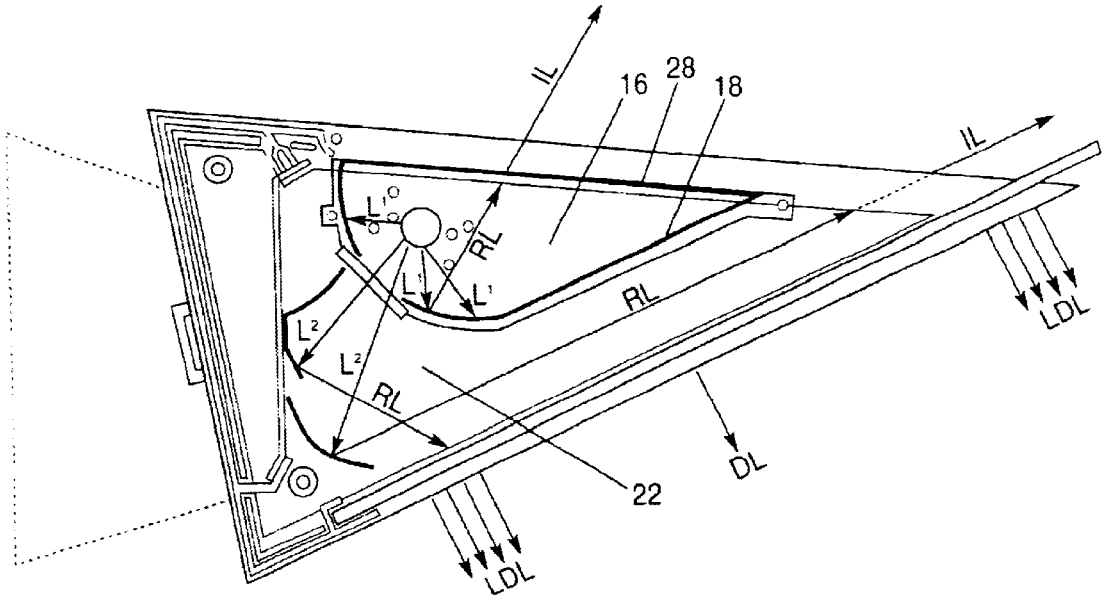
FIG. 6 is a side view of the system for directing light from a luminaire showing light patterns from the luminaire.

By cross-reference between FIGS. 1, 3A, and 5, a first reflecting device 16 is shown to be installed in luminaire 14 for transmitting substantially indirect lighting from luminaire 14. In a preferred embodiment of the present invention, first reflecting device 16 includes an optical surface 18 for reflecting light, an opening 20 for conveying light toward a second reflecting device 22, a window 24 mountable in opening 20 for conveying light, a frame 26 adjacent lamp 12', and a lens 28 insertable in frame 28. As indicated, system for directing light from a luminaire 10, in its broadest aspect, also includes second reflecting device 22. Second reflecting device 22 is mounted in luminaire 14 for transmitting substantially direct lighting and luminous direct lighting from luminaire 14. In a preferred embodiment of the present invention, second reflecting device is a multiple surface reflector assembly 30. Multiple surface reflector assembly 30 is installed in luminaire 14 adjacent opening 20 formed in optical surface 18. In its broadest aspect, system for directing light from a luminaire 10 also includes a fascia 32. Fascia 32 is, in a preferred embodiment of the present invention, slidably engageable with luminaire 14. However, as will be evident to one skilled in the art, fascia 32 may be fixed in luminaire 14. Fascia 32 is provided for emitting substantially luminous direct lighting. As used in this document, the term "substantially indirect lighting" means light that is directed from luminaire 14 substantially downward from source of light 12; the term "substantially direct lighting" means light that is directed from luminaire 14 substantially upward from source of light 12; and the term "substantially luminous direct lighting" means luminous light directed substantially downward from luminaire 14. A diagrammatic example of direct lighting is shown in FIG. 6 by the lines with reference letters DL, and a diagrammatic example of indirect lighting is shown in FIG. 6 by the lines with reference letters IL.

In greater detail, as shown perhaps best in FIG. 5, system for directing light from a luminaire 10 includes source of light 12. In a preferred embodiment of the present invention, source of light may include a lamp 12'. Lamp 12' may include a variety of lamps, including quartz halogen, compact fluorescent, ceramic metal halide, metal halide lamps, fluorescent lamps, incandescent lamps, compact fluorescent lamps, pin-base compact fluorescent lamps in which the reflector is designed around a specific lamp, pendant incandescent lamps, and conventional halogen lamps. Currently, halogen incandescent lamps are considered more efficient than standard incandescent lamps. The term "efficient" pertains to the amount of energy used in producing the same quantity and quality of light. A person skilled in the art, however, will realize that the choice of lamp is not a limitation of the present invention, and that any source of light, and any lamp, could appropriately be used in connection with the practice of the present invention.

As shown by cross-reference between FIGS. 1, 3 and 5, system for directing light from a luminaire 10 includes first reflecting device 16. In a preferred embodiment of the present invention, first reflecting device 16 includes optical surface 18, opening 20 for conveying light toward second reflecting device 22, window 24 mountable in opening 20 for conveying light, frame 26 adjacent lamp 12', and lens 28 insertable in frame 26. In a preferred embodiment of the present invention, optical surface 18 is formed with a concave face 34 and a convex face 36. Concave face 34 is the reflective surface for incident light from lamp 12' as shown best in FIG. 6 as $L^1$. Preferably, concave face 34 of optical surface 18 is approximately 95% specular, peened, and has an anodized asymmetric optical surface. As used in this document, the term "specular" means having the qualities of a mirror, the term "anodized" means that concave face 34 has been subjected to electrolytic action as the anode of a cell so as to coat concave face with a protective or decorative film, and the term "peened" means that concave face 34 of optical surface 18 has been hammered to shape optical surface 18. A person skilled in the art, however, will realize that the preferred embodiment of optical surface 18 is not a limitation of the present invention, and that a wide variety of finishing of optical surface 18 may be employed in practicing the present invention.

As also shown by cross-reference between FIGS. 1, 3A, 3B and 5, first reflecting device 16 includes frame 26. Frame 26 is installed in luminaire 14 adjacent source of light 12. Frame 26 is formed with opposing sides 38*a,b* and opposing ends 40*a,b*. Opposing sides 38*a,b* are each formed with a hollow tube 42 as best shown in FIG. 3B. Opposing spring-loaded pins 44*a–d* are insertable into hollow tubes 42*a–d* in opposing sides 38*a,b*. Opposing spring-loaded pins 44 are provided to secure frame 26 in first reflecting device 16. Lens 28 is demountably insertable in frame 26, but as will be evident to one skilled in the art, lens 28 also may be fixed in frame 26. In a preferred embodiment of the present invention, lens 28 is formed from tempered prismatic glass approximately ⅛ inches thick. A person skilled in the art, however, will realize that neither the choice of material to make lens 28, nor the dimensions of lens 28, are limitations of the present invention, and that a wide variety of materials and dimensions may be employed in making lens 28 to practice the present invention.

Figure 4:
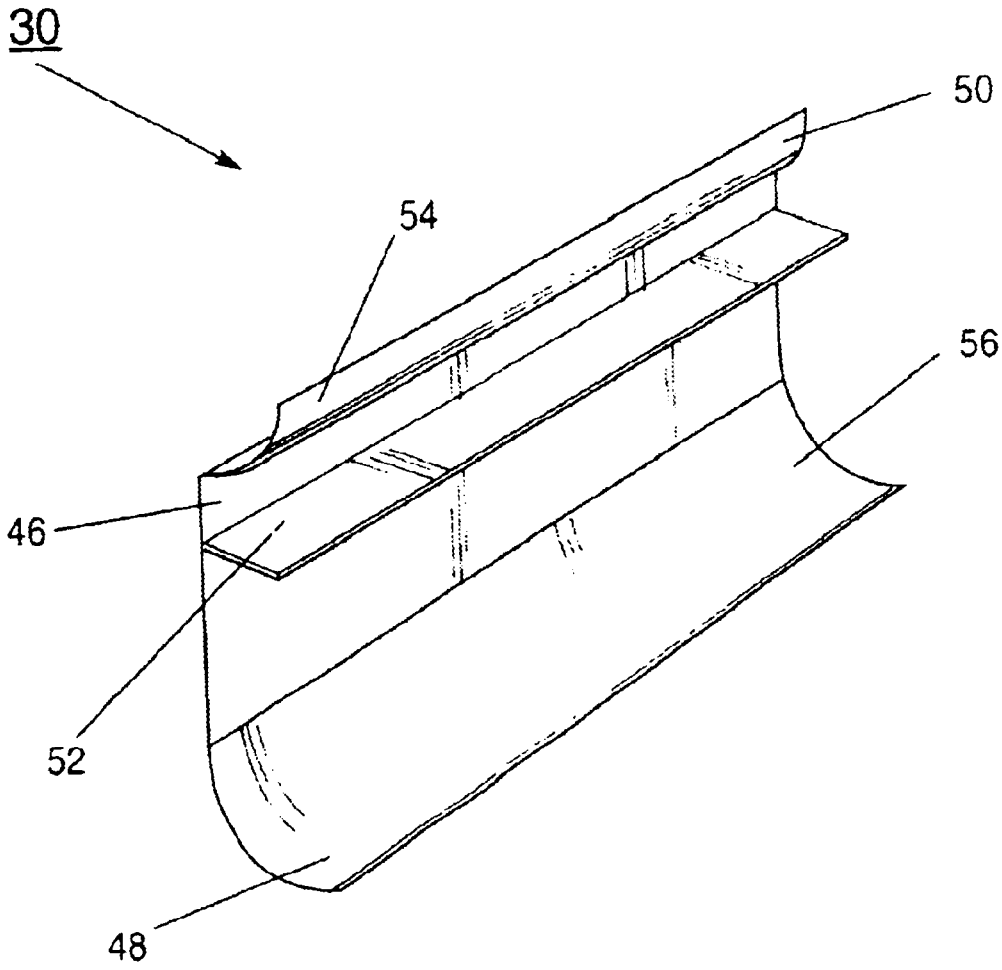
FIG. 4 is a perspective view of the second reflecting device, also described in this document as the multiple surface reflector assembly.

Also in a preferred embodiment of the present invention, as shown by cross-reference among FIGS. 1, 4 and 5, optical surface 18 is formed with opening 20. Opening 20 is formed in optical surface 18 for conveying light toward second reflecting device 22, as shown diagrammatically in FIG. 6 as $L^2$. Generally, the light $L^2$ conveyed through opening 20 is light produced by source of light 12 but not reflected by optical surface 18 as direct light. $L^2$ is "transmitted light" or "unreflected light," as defined earlier in this document. In a preferred embodiment of the present invention, first reflecting device 16 also includes window 24. Window 24 is mountable in opening 20 for conveying and filtering light $L^2$. Also in a preferred embodiment of the present invention, window 24 is opaque and removably mountable in opening 20. Window 24 is opaque to help diffuse and suffuse transmitted light $L^2$. A person skilled in the art, however, will understand that window need be neither opaque nor removable to practice the invention, and that neither opaqueness nor removability of window 24 is a limitation of the present invention.

As indicated, in a preferred embodiment of the present invention, second reflecting device 22 is mounted in luminaire 14 for transmitting substantially direct lighting DL from luminaire 14. In a preferred embodiment of the present invention, second reflecting device 22 is multiple surface reflector assembly 30. As perhaps best shown in FIGS. 4 and 5, multiple surface reflector assembly 30 is installed in luminaire 14 adjacent opening 20 formed in optical surface 18 and adjacent convex face 36 of optical surface 18. Multiple surface reflector assembly 30 is includes a first reflector facet 46. First reflector facet 46 reflects a portion of transmitted light $L^2$ as shown perhaps best in FIG. 6. Multiple surface reflector assembly 30 also includes a second reflector facet 48. Second reflector facet 48 also reflects a portion of transmitted light $L^2$ substantially in a direction best shown in FIG. 6. In a preferred embodiment of system for directing light from a luminaire 10, first reflector facet 46 and second reflector facet 48 are approximately 95% specular, peened, and have an anodized asymmetric optical surface. As shown best in FIG. 4, first reflector facet 46 includes a leading surface 50 and an intermediate surface 52. In a preferred embodiment of the present invention, leading surface 50 is a substantially semi-circular convex surface 54. Second reflector facet 48 includes a substantially trailing concave surface 56. A person skilled in the art, however, will realize that first reflector facet 46 and second reflector facet 48 may include a variety of shapes and configurations depending on lighting results sought to be achieved, and the shapes and configurations of the preferred embodiment are not limitations on the scope of the present invention.

Figure 2:
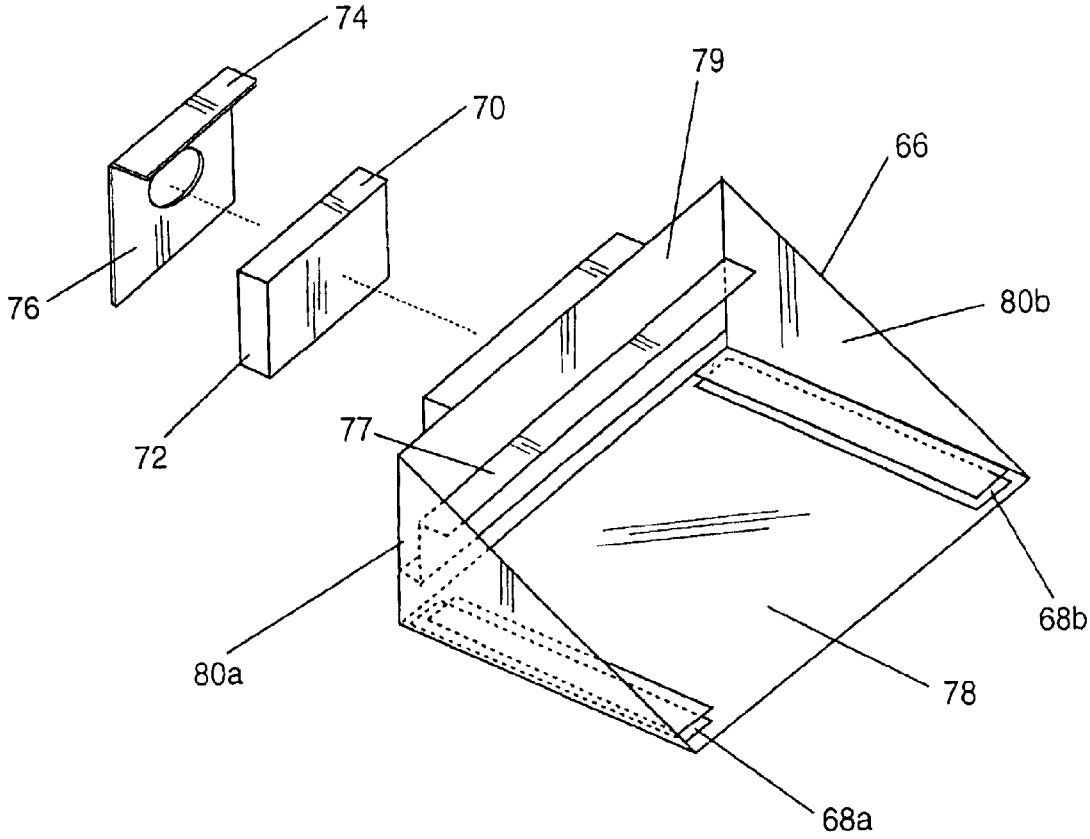
FIG. 2 is an exploded perspective view of the housing, ballast, and connecting plate.

System for directing light from a luminaire 10 also includes fascia 32 as best shown by cross-reference between FIGS. 1 and 5. In a preferred embodiment of the present invention, fascia 32 is formed with a plate 56 having opposing ribs 58*a,b* and opposing segments 60*a,b*. Also in a preferred embodiment of the present invention, fascia 32 includes a lip 62 of varying dimensions as best shown diagrammatically in FIG. 5 as $D^1$. Lip 62 extends varying distance $D^1$ beyond fore edge 64 of housing 66. Lip 62 is provided in a preferred embodiment of the present invention to achieve enhanced direct lighting DL, but as will be evident to one skilled in the art, lip 62 of fascia 32 is not a limitation of the present invention, and plate 56 of fascia 32 may be formed in a variety of shapes and configurations. Fascia 32 emits substantially luminous direct lighting. As used in this document, the term "substantially luminous direct lighting" includes a substantially steady, suffused or glowing direct lighting as shown diagrammatically in FIG. 6 by the reference letters LDL. In a preferred embodiment of the present invention, plate 56 of fascia 32 is made of tempered glass and is preferably approximately 0.188 inches thick. A person skilled in the art, however, will realize that the choice of materials for plate 56 of fascia 32, and the preferable dimensions, are not limitations of the present invention. As also shown in FIGS. 2 and 5, housing 66 of luminaire 14 is formed with opposing channels 68*a,b*. In a preferred embodiment of the present invention, opposing ribs 58*a,b* of fascia 32 are slidably engageable in opposing channels 68*a,b*.

As shown best in FIG. 2, the present invention also includes means 70 for energizing lamp 12'. Means 70 for energizing lamp 12' is coupled to luminaire 14. In a preferred embodiment of the present invention, means 70 for energizing lamp 12' is a ballast 72. Also included in the present invention are means 74 attachable to luminaire 14 for attaching luminaire 14 to an object such as a wall. In a preferred embodiment of the present invention, means 74 for attaching luminaire 14 to an object such as a wall includes a mounting plate 76. Also included in housing 66 is a holder 77. Second reflecting device 22, which in the preferred embodiment of the present invention is multiple surface reflector assembly 30, is mountable on holder 77.

Figure 7:
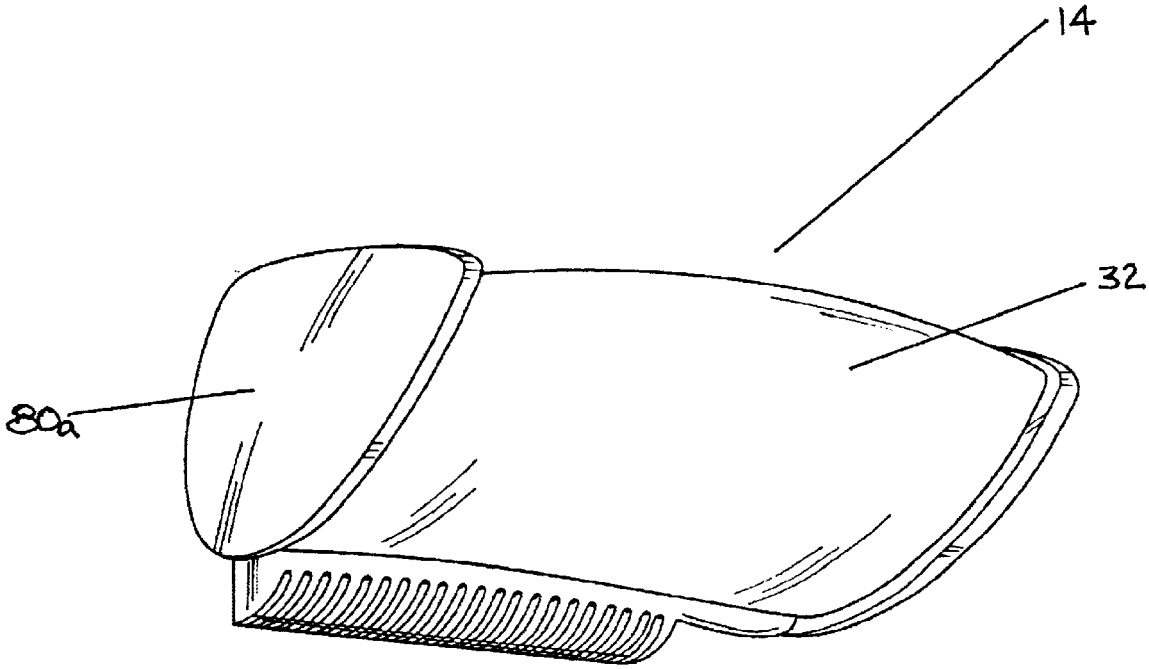
FIG. 7 is a perspective view of an alternative tear drop shape of the housing.

As indicated, and as shown in FIG. 2, luminaire 14 of the present invention also includes housing 66, as best shown by cross-reference between FIGS. 2 and 5. Housing 66 is formed with a base 78, a wall 79, and two opposing end panels 80*a,b* extending monolithically from the base at substantially right angles to base 78. Two opposing end panels 80*a,b* are, in a preferred embodiment of the present invention, substantially triangular in shape. In an alternative embodiment, two opposing end panels 80*a,b* are substantially tear drop in shape, as shown in FIG. 7. A person skilled in the art, however, will realize that the choice of shape of opposing end panels 80*a,b* is not a limitation of the present invention.

In operation, following application of energy through ballast 72, lamp 12' provides incident light $L^1$ that is reflected from optical surface 18 of first reflecting device 16 of luminaire 14. Incident light $L^1$ produces reflected light RL as shown best in FIG. 6. In connection with all lines labeled as showing light and lighting in FIG. 6, it will be understood that the lines are suggestive and diagrammatic only, and are not intended to demonstrate actual angles from the normal which has been described in this document as an imaginary line generally at right angles to a reflective surface. Reflected light RL is directed through lens 28 inserted in frame 26 to produce indirect lighting IL. Substantially simultaneously, a portion of incident light $L^1$ passes through opening 20 in optical surface 18 as transmitted light $L^2$. Transmitted light $L^2$ is directed to second reflecting device 22 which, in a preferred embodiment of the present invention, is multiple surface reflector assembly 30. Transmitted light $L^2$ reflects from first reflector facet 46 and second reflector facet 48 of multiple surface reflector assembly 30, as shown in FIG. 6, to produce direct light and lighting DL that is directed through and along fascia 32. Fascia 32 may be presented in a wide variety of shapes, colors, etchings, and materials to produce varying lighting aesthetics.

While the system for directing light from a luminaire shown in drawing FIGS. 1–7 is one embodiment of the present invention, it is merely one embodiment, is not intended to be exclusive, and is not a limitation of the present invention. While the particular system for directing light from a luminaire as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims. Claim elements and steps in this document have been numbered solely as an aid in readability and understanding. The numbering is not intended to, and should not be considered as, intending to indicate the ordering or sequencing of elements and steps in the claims.

What is claimed is:

1. A system for directing light from a luminaire, comprising:

a source of light removably positionable in the luminaire;

a first reflecting device installed in the luminaire for transmitting substantially indirect lighting from the luminaire, wherein the first reflecting device is formed with an opening and a window for diffusing light;

a second reflecting device mounted in the luminaire for transmitting substantially direct lighting from the luminaire; and a fascia engageable with the luminaire for emitting substantially luminous direct lighting.

2. A system for directing light from a luminaire as recited in claim 1, wherein the first reflecting device includes an optical concave surface for reflecting light.

3. A system for directing light from a luminaire as recited in claim 1, wherein the first reflecting device includes a frame adjacent the source of light.

4. A system for directing light from a luminaire as recited in claim 1, wherein the first reflecting device includes a lens.

5. A system for directing light from a luminaire as recited in claim 1, wherein the second reflecting device is a multiple surface reflector assembly installed in the luminaire adjacent the opening formed in the first reflecting device.

6. A luminaire, comprising:

a housing;

a lamp removably positionable in the housing for providing incident light;

a frame connectable to the luminaire;

an optical surface installable in the housing for reflecting light, wherein the optical surface is formed with an opening;

a window mountable in the opening for conveying transmitted light;

a multiple surface reflector assembly connected to the housing adjacent the window for reflecting the transmitted light;

a luminous direct fascia connectable to the housing for emitting direct lighting;

means coupled to the housing for energizing the lamp; and means connectable to the housing for attaching the luminaire to an object.

7. A luminaire as recited in claim 6, wherein the housing is formed with a wall, a base and two opposing end panels extending monolithically from the base at substantially right angles to the base.

8. A luminaire as recited in claim 7, further comprising opposing spring-loaded pins mounted in the frame for securing the frame in the housing.

9. A luminaire as recited in claim 8, wherein the optical surface is substantially concave.

10. A luminaire as recited in claim 9, wherein the window is substantially opaque.

11. A luminaire as recited in claim 10, wherein the window is removably mountable in the opening.

12. A luminaire as recited in claim 11, wherein the multiple surface reflector assembly includes a first reflector facet for reflecting a portion of the transmitted light.

13. A luminaire as recited in claim 12, wherein the multiple surface reflector assembly includes a second reflector facet for reflecting a portion of the transmitted light.

14. A luminaire as recited in claim 13, wherein the energizing means includes a ballast.

15. A luminaire as recited in claim 14, wherein the energizing means includes means operatively connectable to a source of power.

16. In a luminaire, an apparatus for directing light emissions, comprising:

an optical surface positionable in the luminaire for reflecting light, wherein the optical surface is formed with at least one opening;

a window positionable in the opening for admitting light;

one or more first reflector facets for reflecting light;

one or more second reflector facets for reflecting light; and one or more fascia mountable on the luminaire for emitting light.

17. In a luminaire, an apparatus for directing light emissions as recited in claim 16, further comprising a frame connectable to the luminaire.

18. In a luminaire, an apparatus for directing light emissions as recited in claim 16, further comprising a lens mountable in the frame for filtering and diffusing light.

19. In a luminaire, an apparatus for directing light emissions as recited in claim 16, wherein the one or more second reflector facets includes at least one substantially convex face.

20. In a luminaire, an apparatus for directing light emissions as recited in claim 16, wherein the one or more first reflector facets includes at least one substantially concave face.

21. A method for manufacturing a luminaire, comprising:

forming a housing;

positioning a source of light in the housing;

shaping an optical surface installable in the housing for reflecting light by forming an opening in the optical surface and installing a window in the opening;

forming an opening in the optical surface;

including a lens adjacent the optical surface;

installing a multiple surface reflector assembly in the housing for reflecting light;

selecting a fascia for engagement with the housing; and equipping the luminaire with means for attaching the luminaire to a surface.

22. A method for manufacturing a luminaire as recited in claim 21, wherein the housing forming step includes the substeps of:

forming a base with two opposing end panels extending monolithically at substantially at right angles from the base;

including a wall connectable to the base and two opposing end panels;

shaping the two opposing end panels to be substantially triangular or tear drop in shape;

including opposing channels on the opposing end panels and within the housing; and dimensioning the opposing channels for engagement with the fascia.

23. A method for manufacturing a luminaire as recited in claim 21, wherein the multiple surface reflector assembly installing step includes the substeps of:

forming a first reflector facet;

forming a second reflector facet; and installing the first reflector facet and the second reflector facet within the housing substantially adjacent the opening in the optical surface.

24. A method for making a luminaire providing direct and indirect lighting as recited in claim 22, wherein the luminaire equipping step includes the substep of providing at least a mounting plate.

* * * * *